United States Patent [19]

Pozo

[11] Patent Number: 4,809,883

[45] Date of Patent: Mar. 7, 1989

[54] SAND DISPENSING ASSEMBLY

[75] Inventor: Jaime F. Pozo, Chicago, Ill.

[73] Assignee: Amsted Industries Incorporated, Chicago, Ill.

[21] Appl. No.: 104,945

[22] Filed: Oct. 5, 1987

[51] Int. Cl.[4] ..... B67D 5/52

[52] U.S. Cl. ..... 222/141; 222/144; 222/277; 222/362

[58] Field of Search ..... 222/138–142, 222/362, 427–429, 269–270, 276, 277, 144, 144.5, 145, 142.5

[56] References Cited

U.S. PATENT DOCUMENTS

| | | | |
|---|---|---|---|
| 842,167 | 1/1907 | Berg | 222/141 |
| 1,098,667 | 6/1914 | Henry | 222/141 X |
| 2,164,333 | 7/1939 | Mann | 222/141 X |
| 2,200,755 | 5/1940 | McArthur | 222/142.5 |
| 2,399,016 | 4/1946 | Gits | 222/277 X |
| 2,578,538 | 12/1951 | Gray | 222/142.5 |
| 2,973,117 | 2/1961 | Conklin | 222/362 X |

*Primary Examiner*—Kevin P. Shaver
*Assistant Examiner*—Steve Reiss
*Attorney, Agent, or Firm*—Edward J. Brosius; Charles E. Bouton

[57] ABSTRACT

A sand dispensing assembly is provided wherein two different sands are held in two bins in a top section. The bins are concentric and generally cylindrical. A middle section of the sand dispensing assembly includes a plurality of inner dispensing tubes at a first diameter from the center of the middle section and a plurality of outer dispensing tubes at a second diameter greater than the first diameter from the center of the middle section. A bottom of the sand dispensing assembly includes a plurality of discharge funnels. When the middle section is at a first position, sand fills the inner dispensing tubes from the first bin while sand exits the outer tubes through the discharge funnels. When the middle section is rotated to a second position, sand fills the outer dispensing tubes from the second bin while sand exits the inner tubes through the discharge funnels.

1 Claim, 4 Drawing Sheets

SAND DISPENSING ASSEMBLY

BACKGROUND OF THE INVENTION

The present invention relates to dispensing mechanisms and, more particularly, to a sand dispensing mechanism wherein sand from two different storage bins can be loaded into and discharged from two sets of dispensing tubes.

As described in U.S. Pat. No. 3,735,796, assigned to the assignee of the present invention, it is known in the metal casting art that molds must be provided with risers. Such risers assure that gases can exit the mold during pouring, especially in the bottom pressure casting of railway wheels using two piece graphite molds that are sealed together during pouring. Further, the risers assure that sufficient metal is present in the mold during cooling to flow back down into the mold cavity to minimize casting shrinkage or the formation of cavities.

In graphite molds, it is desirable to line such risers with a refractory sand-resin binder mixture to protect the mold. The bottom sand in such riser is desire to be fine as such sand will face the casting. It is desirable if such sand is new, unbaked sand. The sides of the riser can be lined with coarser sand, which could be reused from prior riser lining. The lined riser has been previously heated, so an amount of the lining sand will harden and remain, while a portion of the sand will be shaken out for reuse. The metal mold liner that formed the bottom of the riser for the sand to form about is removed. A hole is punched in a raised portion of the facing sand to form a sprue having a smaller cross section than the riser to facilitate knocking off the riser after pouring and solidification of the casting. The sprue opening permits gas outlet and metal storage in the riser.

It is an object of the present invention to provide a sand dispensing mechanism capable of readily depositing one type of sand in the bottom of the riser openings and another type of sand to line the riser sides.

SUMMARY OF THE INVENTION

The present invention comprises a sand dispensing mechanism having three sections. A top section is used for bulk storage of two types of sand-resin mixtures, a middle section with two sets of dispensing tubes and a bottom section with discharge funnels.

The top section of the sand dispensing mechanism comprises two concentric bins each filled with a different type of sandresin mixture. An inner sand storage bin is cylindrical, with a cylindrical outer wall. The outer wall of the inner bin forms a partition between the inner section and an outer sand storage bin. The outer storage bin is cylindrical in shape.

The middle section of the sand dispensing mechanism is rotatable and includes a plurality of inner dispensing tubes at a first diameter from the center of the middle section and a plurality of outer dispensing tubes at a second diameter outboard from the inner tubes. A top plate covers the inner and outer tubes and includes a plurality of openings. The openings are arranged such that when the middle section is at a first position, each of the inner dispensing tubes is in operative alignment with an opening in the top plate. This permits sand from the inner sand storage bin to fall into and fill the inner dispensing tubes. At the same time, the outer tubes are each aligned with a closed portion of the top plate so as not to permit filling from the outer sand bin.

When the middle section is rotated to a second position, each of the outer dispensing tubes is in operative alignment with an opening in the top plate. This permits sand from the outer sand storage bin to fall into and fill the outer dispensing tubes. At the same time, the inner tubes are each aligned with a closed portion of the top plate so as not to permit filling from the inner sand bin.

The bottom section of the sand dispensing mechanism includes a plurality of discharge funnels arranged in a circular pattern. The top of each discharge funnel includes an opening in a bottom plate. When the middle section of the sand dispensing mechanism is at the first position, each of the outer dispensing tubes is in operative alignment with an opening in the bottom plate to permit sand to flow out of the outer dispensing tube into the discharge funnel. At the same time, each of the inner dispensing tubes has its bottom opening above a closed section of the bottom plate to permit the inner dispensing tube to be filled with sand.

When the middle section is rotated to the second position, each of the inner dispensing tubes is in operative alignment with an opening in the bottom plate to permit sand to flow out of the inner dispensing tube into the discharge funnel. At the same time, each of the outer dispensing tubes has its bottom opening above a closed section of the bottom plate to permit the outer dispensing tube to be filled with sand.

Although the main application of the present invention is for use in the dispensing of sand into a foundry mold riser, there may well be other applications such as the dispensing of chemical powders, grains or similar pulverized or granulated materials.

DESCRIPTION OF THE PREFERRED EMBODIMENT

Figure 1:
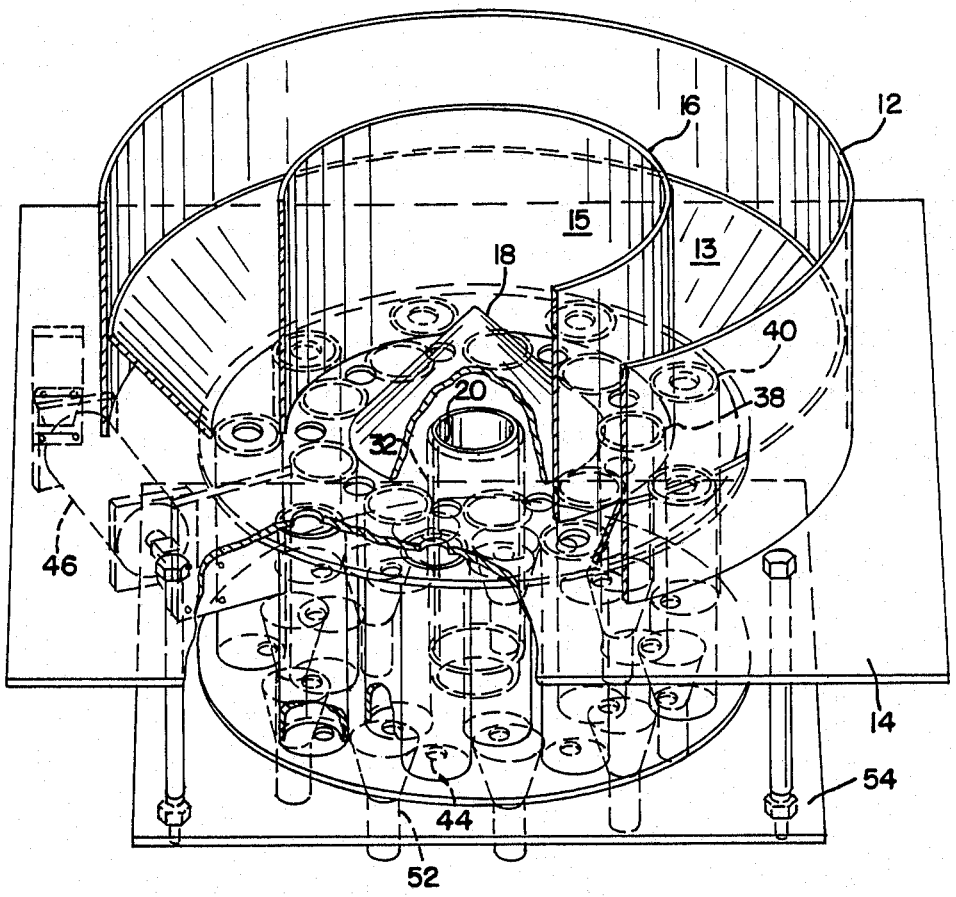
FIG. 1 is a perspective view in partial cross section of the sand dispensing assembly of the present invention.
Figure 2:
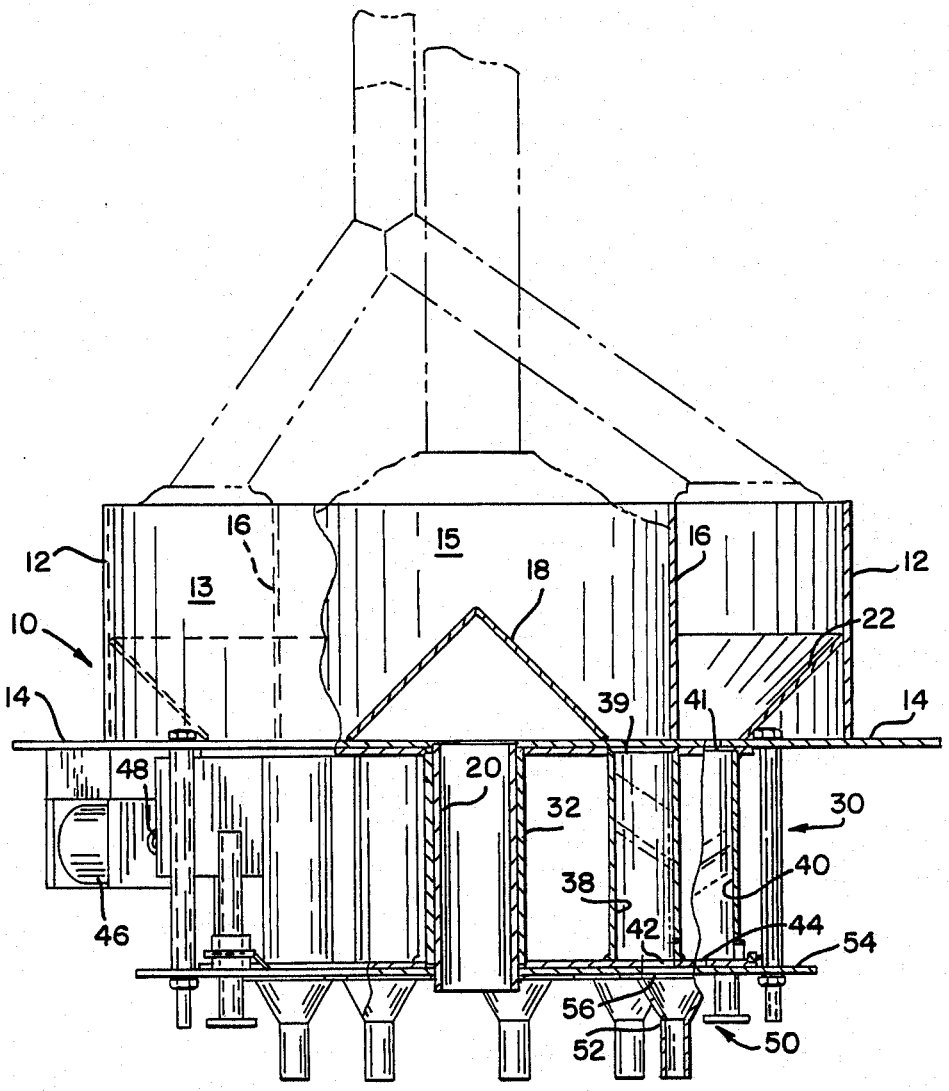
FIG. 2 is a cross sectional side view of the sand dispensing assembly of the present invention.
Figure 3:
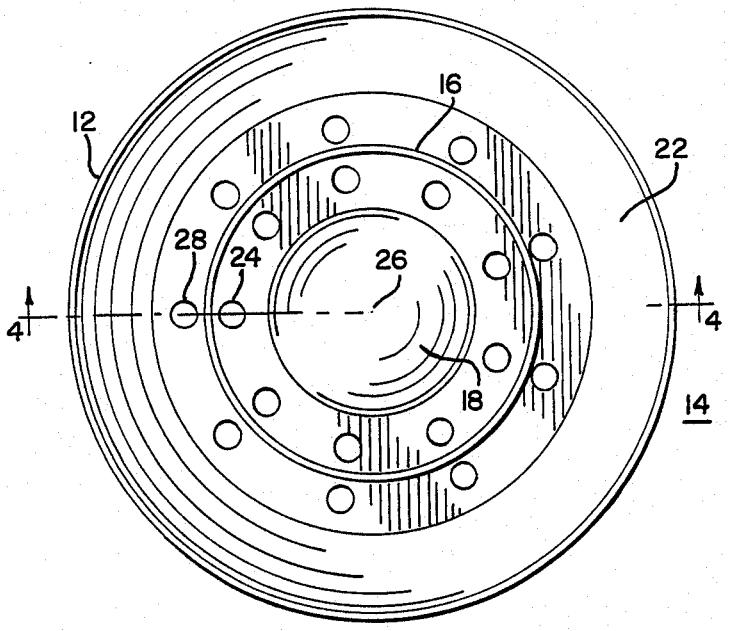
FIG. 3 is a top view of the sand container top section of the sand dispensing assembly of the present invention.
Figure 4:
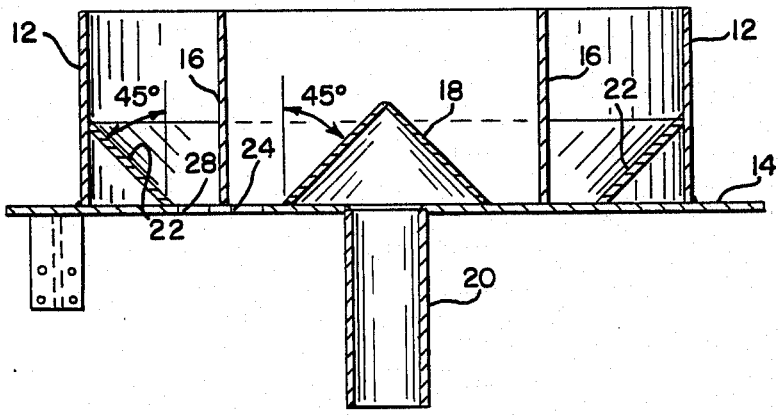
FIG. 4 is a cross sectional side view of the sand container top section along lines 4—4 of FIG. 3.

Referring now to FIGS. 1–4 of the drawings, a sand dispensing assembly in accordance with a preferred embodiment of the present invention is shown generally at 10. The top section or sand storage bin is comprised of an outer cylindrical wall 12 mounted on a circular bottom plate 14, which is usually a square planar plate. An inner partition is formed by inner cylindrical wall 16. Outer sand storage bin 13 is formed between outer wall 12, inner wall 16 and bottom plate 14. Inner sand storage bin 15 is formed by inner wall 16 and bottom plate 14. A conical floor structure 18 is centrally located in inner sand storage floor structure 18 is centrally located in inner sand storage bin 15. A cylindrical center support 20 extends downwardly from the center of bottom plate 14. Support plate 22 extends above the junction of outer wall 12 and bottom plate 14.

One type of sand or other desired granular material can be stored in outer bin 13 and another type of sand or other desired granular material can be separately stored in inner bin 15.

Bottom plate 14 includes a plurality of inner sand outlet holes 24 arranged in a circular pattern at a first radial distance from center 26 of the circular pattern. Bottom plate 14 also includes a plurality of outer sand outlet holes 28 arranged in a circular pattern at a second radial distance from center 26 greater than the first radial distance of the inner sand outlet holes 24.

Figure 5:
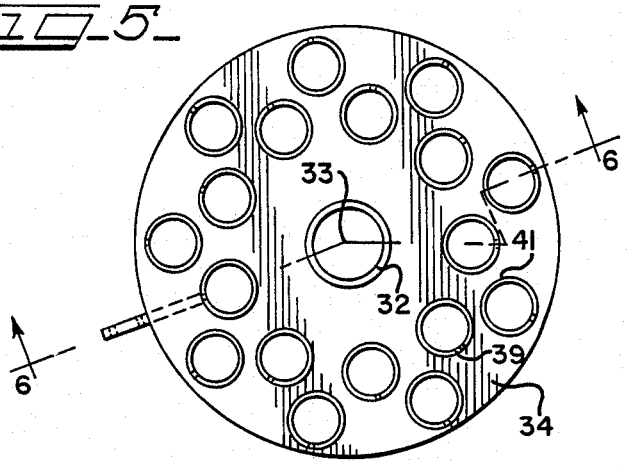
FIG. 5 is a top view of the dispensing tube middle section of the sand dispensing assembly of the present invention.
Figure 6:
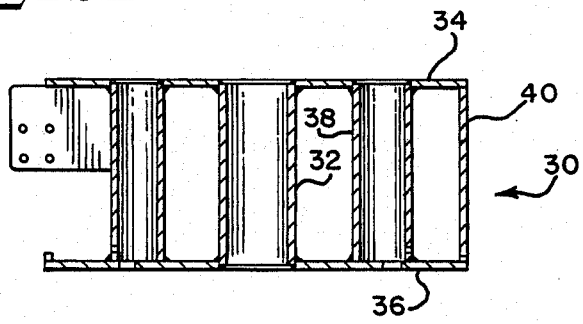
FIG. 6 is a cross sectional side view of the dispensing tube middle section along lines 6—6 of FIG. 5.
Figure 7:
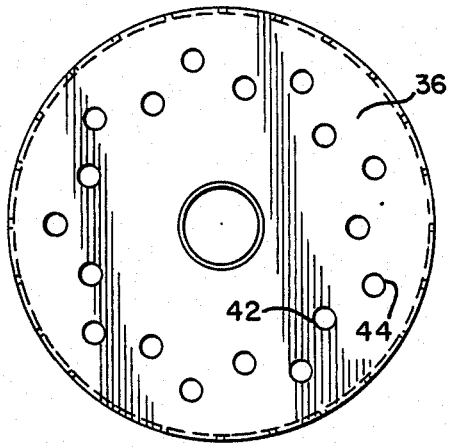
FIG. 7 is a bottom view of the dispensing tube middle section of the sand dispensing assembly of the present invention.

Referring now to FIGS. 5–7, the middle section of the sand dispensing assembly is shown generally at 30. Middle section 30 is comprised of a circular top plate 34 and a circular bottom plate 36. A centrally located cylindrical support 32 in middle section 30 is adapted to receive cylindrical center support 20 of the top section. Top plate 34 and bottom plate 36 are joined by a plurality of cylindrical tubes. An inner group of tubes 38 are arranged in a circular pattern at a first radial distance from center 33 of top plate 34. An outer group of tubes 40 are arranged in a circular pattern at a second radial distance greater than the first radial distance of inner tubes 38 from center 33 of top plate 34. The inner tubes 38 are equal in number to the outer tubes 40. Further, inner tubes 38 and outer tubes 40 are offset such that their centers do not lie on the same radii from center 33; rather, each outer tube 40 is located along a radius at an equal distance between two adjacent inner tubes 38. Inner tubes 38 have top openings 39 in top plate 34 equal in diameter to the diameter of inner tube 38. Outer tubes 40 have top openings 41 in top plate 34 equal in diameter to the diameter of outer tube 40.

Inner tubes 38 have bottom openings 42 in bottom plate 36 smaller in diameter than the diameter of inner tubes 38. Outer tubes 40 have bottom openings 44 in bottom plate 36 smaller in diameter than the diameter of outer tubes 40. Bottom openings 42 are located near the radial outermost section of inner tube 38, and bottom openings 44 are located near the radial innermost section of outer tube 40.

Cylinder 46 has an end of operating piston 48 attached to middle section 30 such that, upon the extension of operating piston 48, middle section 30 is rotated.

A bottom section of sand dispensing assembly is shown generally at 50. Bottom section 50 is comprised of a top plate 54 with a plurality of funnels 52 extending downwardly therefrom. Funnels 52 are all located in a circular pattern at a first radial distance from the center of plate 54. Further, the top opening 56 of each funnel 52 through top plate 54 is of a sufficient diameter that when either inner opening 42 or outer opening 44 of bottom plate 36 is placed over top opening 56, the contents of dispensing tube 38 or 40 are discharged through funnel 52.

In operation, when middle section 30 is at a first position, inner dispensing tubes 38 are filled with sand from inner bin 15. Inner sand outlet holes 24 in bottom plate 14 are aligned with top openings 39 in top plate 34. Outer sand outlet holes 28 are over a closed portion of top plate 34 so they are not being filled with sand from outer bin 13. At the same time, sand is discharged from outer dispensing tubes 40. Bottom openings 44 in outer dispensing tubes 40 are aligned with top openings 56 of funnels 52 to allow the discharge of sand from outer dispensing tubes 40. Bottom openings 42 of inner dispensing tubes 38 are aligned with a closed portion of top plate 54 to prevent sand discharge therefrom.

When middle section 30 is rotated to a second position, outer dispensing tubes 40 are filled with sand from outer bin 13. Outer sand outlet holes 28 in bottom plate 14 are aligned with top openings 41 in top plate 34. Inner sand outlet holes 24 are over a closed portion of top plate 34 so they are not being filled with sand from inner bin 15. At the same time, sand is discharged from inner dispensing tubes 38. Bottom openings 42 in inner dispensing tubes 38 are aligned with top openings 56 of funnels 52 to allow the discharge of sand from inner dispensing tubes 38. Bottom openings 44 of outer dispensing tubes 40 are aligned with a closed portion of top plate 54 to prevent sand discharge therefrom.

What is claimed is:

1. A sand dispensing device comprising a sand storage section including an inner generally cylindrical storage chamber and an outer generally cylindrical storage chamber concentric with and radially outboard from said inner storage chamber, a sand dispensing tube assembly located below said sand storage section, said sand dispensing tue assembly including an inner set of tubes arranged in a circular pattern and an outer set of tubes arranged in a circular pattern concentric with and radially outboard from said inner set of tubes, means to rotate said sand dispensing tube assembly, a top plate between said sand storage section and said sand dispensing tubes, said top plate having a plurality of inner openings arranged in a circular pattern at a first radial distance around said top plate and a plurality of outer openings arranged in a circular pattern at a second radial distance radially outboard from and concentric with said first radial distance around said top plate such that, upon the rotation of said sand dispensing tube assembly to a first position, each one of said inner set of tubes is aligned with one of said inner openings of said top plate to permit sand to fall from said inner storage chamber through said inner openings and into said inner tubes, and, upon the rotation of said sand dispensing tube assembly to a second position, each one of said outer set of tubes is aligned with one of said outer openings of said top plate to permit sand to fall from said outer storage chamber through said inner openings and into said outer tubes, a bottom plate below said dispensing tube assembly, said bottom plate including an inner set of openings arranged in a circular pattern at a selected radius around said bottom plate and an outer set of openings arranged in a circular pattern at a second, larger radius such that, upon the rotation of said sand dispensing tube assembly to said first position, said outer set of tubes are at least partially aligned with said outer openings in said bottom plate to permit sand to fall from said outer set of tubes, and, upon the rotation of said sand dispensing tube assembly to said second position, said inner set of tubes are at least partially aligned with said inner openings in said bottom plate to permit sand to fall from said inner set of tubes, and a plurality of discharge funnels each aligned below each opening of said inner and outer set of openings in said bottom plate.

* * * * *